US006583247B1

(12) United States Patent
Alvarino et al.

(10) Patent No.: US 6,583,247 B1
(45) Date of Patent: Jun. 24, 2003

(54) PROCESS FOR PRODUCING FREE RADICAL POLYMERIZED COPOLYMERS

(75) Inventors: Ariel Alvarino, Kenilworth, NJ (US); Ricardo A. Bloch, Scotch Plains, NJ (US); David J. Martella, Princeton, NJ (US); John V. Redpath, North Brunswick, NJ (US); James M. Gardiner, Oxon (GB); Steven W. McKeown, Houston, TX (US); Arunas T. Lapinas, Pittstown, NJ (US)

(73) Assignee: Infineum International Ltd. (GB)

( * ) Notice: Subject to any disclaimer, the term of this patent is extended or adjusted under 35 U.S.C. 154(b) by 0 days.

(21) Appl. No.: 09/270,376

(22) Filed: Mar. 16, 1999

(51) Int. Cl.[7] ..... C08J 4/28

(52) U.S. Cl. ..... 526/227; 526/80; 526/189; 526/190; 526/229; 526/323.2; 526/325

(58) Field of Search ..... 526/184, 325, 526/227, 80, 323.2, 229; 560/190

(56) References Cited

U.S. PATENT DOCUMENTS

| | | | | |
|---|---|---|---|---|
| 2,200,437 A | | 5/1940 | Voss et al. | 260/86 |
| 2,618,602 A | | 11/1952 | Bartlett | 252/56 |
| 2,825,717 A | | 3/1958 | Cashman et al. | 260/78.5 |
| 2,936,300 A | | 5/1960 | Tutwiler et al. | 260/78.5 |
| 3,250,715 A | | 5/1966 | Wyman | 252/56 |
| 3,507,908 A | | 4/1970 | Young et al. | 260/485 |
| 3,784,528 A | | 1/1974 | Reinbek et al. | 260/78.5 T |
| 3,814,690 A | * | 6/1974 | Song | |
| 4,088,589 A | | 5/1978 | Rossi et al. | 252/56 R |
| 4,220,744 A | | 9/1980 | Tulacs et al. | 526/86 |
| 4,661,121 A | | 4/1987 | Lewtas | 44/70 |
| 4,661,122 A | | 4/1987 | Lewtas | 44/70 |
| 4,670,130 A | * | 6/1987 | Dekraker et al. | 208/33 |
| 4,713,088 A | | 12/1987 | Tack et al. | 44/62 |
| 4,772,674 A | | 9/1988 | Shih et al. | 526/325 |
| 4,956,492 A | | 9/1990 | Dekraker et al. | 560/190 |

FOREIGN PATENT DOCUMENTS

| | | | |
|---|---|---|---|
| BE | 658 570 A | 7/1965 | |
| FR | 2 155 983 A | 7/1985 | C08F/1/100 |
| GB | 1 080 910 | 8/1967 | C08F/15/20 |
| WO | WO97/18335 | 5/1997 | |

* cited by examiner

*Primary Examiner*—Tatyana Zalukaeva

(57) ABSTRACT

Process for the copolymerization of free radical polymerizable comonomers such as vinyl acetate with an unsaturated diester such as diakyl fumarate which is carried out in the presence of water to produce copolymers such as fumarate vinyl acetate copolymers useful as lubricating oil and fuel oil additives, for example, as wax crystal modifiers and flow improvers.

27 Claims, No Drawings

PROCESS FOR PRODUCING FREE RADICAL POLYMERIZED COPOLYMERS

FIELD OF THE INVENTION

The present invention relates to processes for the copolymerization of a diester and an unsaturated polycarboxylic acid ester in the presence of a peroxide catalyst. In particular, the present invention relates to the copolymerization of vinyl acetate and specific diesters, for example, dialkyl fumarate-vinyl acetate copolymers (FVA copolymers). FVA copolymers are particularly useful as lube oil flow improvers (LOFIs) or pour point depressants in lubricating oils as well as wax crystal modifiers for fuels and middle distillates.

BACKGROUND OF THE INVENTION

In the field of lubricating oil additives, it has been known for many years that various polymers and copolymers can be used as additives for improving a number of the desirable characteristics of these lubricating oils. For instance, certain of these additives have been found to be useful for improving the viscosity index or the rate of change of viscosity of various oil compositions with changes in temperatures, and/or for improving the pour point of lubricating oils, that is lowering the temperature at which they lose their flow properties, as well as other such lubricating oil properties. In particular, it has been known for many years that various polymers and copolymers of acrylate esters, and polymers and copolymers of alpha-beta unsaturated polycarboxylic acid esters have potential utility for such purposes. These compounds, and particularly the copolymers of vinyl acetate and dialkyl fumarates, have been found to be particularly useful for such purposes. Thus, these fumarate vinyl acetate copolymers have been used commercially as lubricating oil additives, primarily because of their ability to act as lubricating oil flow improvers. These compounds can also be used as wax crystal modifiers, such as cloud point depressants for diesel fuels, and as flow improvers for middle distillates and heavy fuels.

Cashman et al, U.S. Pat. No. 2,825,717, discloses that these additives can be produced by the copolymerization of certain polycarboxylic acid esters, and most particularly fumaric acid diesters and maleic acid diesters, with other polymerizable materials, such as vinyl compounds, and most particularly vinyl acetate, in the presence of a peroxide catalyst, in an alkaline medium. The processes disclosed in Cashman et al include both bulk polymerization and solution polymerization processes in which the reaction is run at temperatures of up to 250° F., but preferably between about 100° and 200° F., and in the presence of an alkaline medium. An alkaline medium is essential to the Cashman et al process apparently in order to neutralize the residual acid in the first step of the Cashman et al process in which the fumarate is prepared. Commercial processes for the production of these additives are often conducted in the presence of a solvent, such as heptane, hexane, or cyclohexane.

Tutwiler et al, U.S. Pat. No. 2,936,300, discloses processes for the copolymerization of vinyl acetate with a dialkyl fumarate in which the reactants are mixed with a solvent or diluent such as white oil in the presence of peroxide catalysts, such as benzoyl peroxide, with cooling to absorb the heat of polymerization so that the reactions are run at temperatures of from 50° to 125° C. (122° to 257° F.). Also, Young et al, U.S. Pat. No. 3,507,908, discloses the copolymerization of dialkyl fumarate with vinyl esters in the presence of a trialkyl aluminum catalyst utilizing a solvent polymerization reaction. These patents are typical of those processes in which it has been believed that the presence of a solvent was essential not only to maintain a workable viscosity, but even more importantly to act as a chain transfer agent in order to terminate these free radical catalytic reactions. It was also believed that the presence of a solvent was required so that its evaporation would moderate the reaction temperatures of these exothermic reactions.

Other patents have discussed bulk polymerization processes of various kinds. These include Voss et al, U.S. Pat. No. 2,200,437, in which vinyl esters of organic acids, including vinyl acetate, are polymerized in the presence of peroxides of the fatty acids containing at least 16 carbon atoms, with the patentee contending that they unexpectedly discovered that by using such catalysts higher molecular weight polymerization products can be produced, specifically compared to the use of catalysts such as dibenzoyl peroxide and the like. In particular, in example 4 of this patent the vinyl acetate is copolymerized with maleic acid dimethyl ester with oleic acid peroxide at 80° C. (176° F.). This disclosure does not mention, however, the fumarates as a candidate for any of the copolymerization reactions thereof. The maleic acid esters of Voss et al are not, however, nearly as effective as pour point depressants as are the fumarate copolymers of the present invention. Trulacs et al, U.S. Pat. No. 4,220,744, discloses other bulk polymerization processes, in this case employing acrylic monomers and minor quantities of alpha, beta-unsaturated monomers therewith.

U.S. Pat. No. 4,772,674 (C. K. Shih, et al.), the disclosure of which is incorporated herein by reference, discloses a solventless process for producing dialkyl fumarate-vinyl acetate copolymers using a peroxide catalyst; the copolymers are disclosed as being useful as lubricating oil and fuel oil additives.

Redpath et al, U.S. Pat. No. 5,939,365, the disclosure of which is incorporated herein by reference, discloses that higher molecular weight (i.e., 50,000 to 350,000 Daltons) FVA copolymers can be made by changes in conventional process conditions, including reaction temperature, residence time, free radical initiator concentration, number of initiator additions during reaction and the molar ratio of vinyl acetate to dialkyl fumarate (VA:DAF). Furthermore, such higher molecular FVA copolymers were demonstrated to significantly improve low temperature properties of formulated oils comprising an alkylewne/alkylene viscosity index copolymer and to perform particularly well in catalytic and isodewaxed basestocks at competitive treat rates and are expected to perform well in other lubricant and fuel applications, including power transmission fluids, gear oils, tractor hydraulic fluids (THF). However, improvements obtained by employing, in particular, lower reaction temperatures to increase the molecular weight of the copolymer tend to increase the viscosity of the reaction mixture, making it more difficult to mix and pump the copolymer. Furthermore, use of a lower reaction temperature can also reduce the reaction rate.

Other patents disclose copolymerization of the class of copolymers of interest in the present invention, but each of these is directed to the specific nature of the copolymer components or their precursors in order to achieve a particular improvement in performance. Included in this group of disclosures is U.S. Pat. No. 2,618,602 (Bartlett), U.S. Pat. No. 4,088,589 (Rossi et al.), U.S. Pat. No. 3,250,715 (Wyman), U.S. Pat. No. 4,713,088 (Tack), U.S. Pat. No. 4,661,121 (Lewtas) and U.S. Pat. No. 4,661,122 (Lewtas).

Copolymers of dialkyl fumarate-vinyl acetate in which a large proportion of the alkyl groups are $C_{20}$ to $C_{24}$ alkyl groups are also known to function as dewaxing aids, see e.g., U.S. Pat. Nos. 4,670,130 and 4,956,492 (A. R. Dekraker and D. J. Martella).

The search has therefore continued for improvements to commercially acceptable processes for copolymerization of vinyl acetate and fumaric acid diesters for the production of these fuel and lubricating oil additives which can be conducted in either the presence or absence of a solvent medium.

SUMMARY OF THE INVENTION

A process comprising the copolymerization of:

(a) unsaturated carboxy ester monomer selected from at least one compound represented by formulas (I) or (II), said compound formed via the esterification of an unsaturated carboxylic acid or its corresponding anhydride with one or more monohydric aliphatic alcohols having an average carbon number of between about 6 to 24, said unsaturated carboxy ester having the formula:

(I)

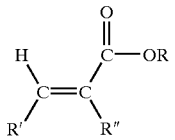

(II)

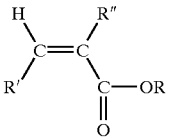

wherein R' is selected from the group consisting of hydrogen and COOR and wherein R is a $C_1$ to $C_{24}$ alkyl group and wherein R" is hydrogen or methyl; and (b) a monomer selected from the group consisting of:

(i) a vinyl ester having the formula:

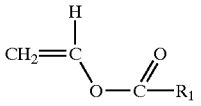

wherein $R_1$ comprises an alkyl group containing from 1 to 18 carbon atoms; and;

(ii) an olefin having the formula

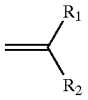

wherein $R_1$ and $R_2$ can independently be hydrogen, an alkyl having from 1 to 28 carbon atoms, or a substituted aryl group, provided both $R_1$ and $R_2$ are not hydrogen;

in a reactor, comprising reacting said unsaturated carboxy ester with said vinyl ester or olefin monomer in the presence of a peroxide catalyst, and in the further presence of water.

The process of the present invention is particularly versatile in that it can be practiced in solution, in bulk, and at low or high temperatures. The introduction of a controlled concentration of water into the reaction mass results in increased molecular weight of the copolymer produced and permits flexibility in the choice of reaction conditions, including, for example, the use of increased temperatures to reduce the viscosity of the reaction mass and improve mixing, reaction rate and conversion. Additionally, the advance claimed herein permits the use of diluents such as mineral oil, which have previously been observed to have a depressing affect on molecular weight of the copolymer.

DETAILED DESCRIPTION

The monomers which are to be copolymerized in accordance with the present invention have a general formulas as follows:

(a) at least one unsaturated carboxy ester monomer selected from compounds represented by formulas (I) or (II), said compound formed via the esterification of an unsaturated carboxylic acid or its corresponding anhydride with one or more monohydric aliphatic alcohols having an average carbon number of between about 6 to 24, said unsaturated carboxy ester having the formula:

(I)

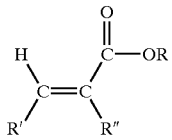

(II)

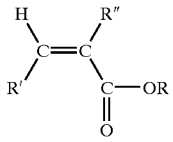

wherein R' is selected from the group consisting of hydrogen and COOR and wherein R is a $C_1$ to $C_{24}$ alkyl group and wherein R" is hydrogen or methyl; and (b) a monomer selected from the group consisting of (i) a vinyl ester having the formula:

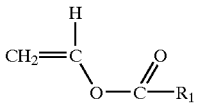

wherein $R_1$ comprises an alkyl group containing from 1 to 18 carbon atoms; and (ii) an olefin having the formula

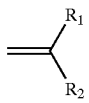

wherein $R_1$ and $R_2$ can independently be hydrogen, an alkyl having from 1 to 28 carbon atoms, or a substituted aryl group, provided both $R_1$ and $R_2$ are not hydrogen.

As noted, the diesters can be prepared by an esterification reaction between unsaturated polycarboxylic acids or their corresponding anhydrides as is well known in the art, and as for example is specifically disclosed beginning at column 2, line 35 of Cashman et al, U.S. Pat. No. 2,825,717, which disclosure is incorporated herein by reference thereto.

More specifically, primary alcohols used for esterification are preferred over secondary and tertiary alcohols, although secondary alcohols are sometimes suitable. The alcohols are preferably saturated, although some degree of unsaturation is permissible when mixtures of alcohols are employed. Straight chain or lightly branched alcohols are preferred over highly branched alcohols. Provided that the average carbon number of the alcohol meets the following criteria, one or more alcohols, i.e., a mixture of alcohols, can be used. There should be sufficient hydrocarbon content to insure solubility of the final copolymer products in the oil or fuel products in which the copolymer is used. In the case of oils, the alcohol or mixture of alcohols should have, on average, at least about 7.5 carbon atoms per molecule; alternatively, at least about 6, preferably at least about 7, more preferably at least about 7.5, most preferably at least about 8 carbon atoms per molecule. It is desirable to select the alcohol(s) in preparing the esters so that the final copolymer product will perform optimally in the end-use composition for which it is intended, e.g., a fuel or a lubricant. It will be appreciated that differences in the selection of the basestock can have a significant affect on the choice of copolymer product, e.g., use of a catalytically dewaxed basestock may require more careful selection of the copolymer characteristics in order to achieve acceptable performance. Suitable alcohols include a broad spectrum of alcohols such as methyl, ethyl, propyl, butyl, pentyl, hexyl, octyl, isooctyl, 2-ethylhexyl, nonyl, 2,2,4,4-tetramethylamyl, decyl, dodecyl, tetradecyl, hexadecyl, octadecyl, cetyl, lauryl, and stearyl alcohols. Mixtures of these can be used so long as the components of the mixture are adjusted so that the average number of carbon atoms of the mixture is between 6 and about 24; preferably between 7 and 22; most preferably between 8 and about 20; for example, between about 10 and about 18. Alternatively, useful product can be prepared utilizing single alcohols, for example, those having 8 or 22 carbon atoms.

In the above formulas I and II, when R" is selected from hydrogen or methyl includes methacrylate monomers; when the cis- form of the ester monomer is employed, maleate monomers are included. Consequently, useful monomers described above include fumarates, acrylates, methacrylates, maleates and mixtures thereof. Based on the nature of the copolymer which is desired as a commercially attractive product, at least one unsaturated carboxy ester monomer of type (a) above will be used in the polymerization process.

While various second monomers can be selected from the generic formula represented as component (b)(i) or (b)(ii), above, the preferred embodiment contemplates the use of vinyl compounds, particularly vinyl esters and their substitution products. Vinyl fatty acid esters are particularly useful, such as vinyl acetate, vinyl propionate, vinyl butyrate, vinyl laurate, vinyl stearate and the like. Mixtures of such vinyl esters may be used in place of relatively pure vinyl ester. Vinyl acetate is particularly preferred.

Water is preferably introduced so that the copolymerization occurs in the presence of water. Usefully, the amount of water is from about 200 to about 10,000 parts per million (ppm) by weight of the copolymerizing monomers and peroxide; broadly, from about 500 to about 10,000 ppm; preferably from about 500 to about 5,000 ppm; more preferably from about 750 to about 4,000 ppm. In order to avoid corrosion problems in the system, it is advantageous to keep the level of moisture to less than about 5,000 ppm; other useful concentrations include less than about 3,000 ppm, e.g., from about 500 to about 3,000 ppm. Similarly, the choice of water concentration will take into consideration whether or not any of the reactants are subject to being negatively affected by, e.g., the formation of a complex or by hydrolysis.

Various methods of introducing water into the process are contemplated by the invention. For example, water can be introduced by means selected from the group consisting of a separate feedstream; or included with one or more of: (a) the monomers to be copolymerized; (b) the solvent, where a solvent is employed in the process; or (c) with the catalyst; or combinations of such alternatives.

Water can also be present during the polymerization as a consequence of its formation during an esterification reaction based on the use of a partially esterified unsaturated carboxy ester monomer which esterification is brought to further completion in the polymerization reactor, thereby generating water in situ. The following reaction illustrates such an alternative process feature:

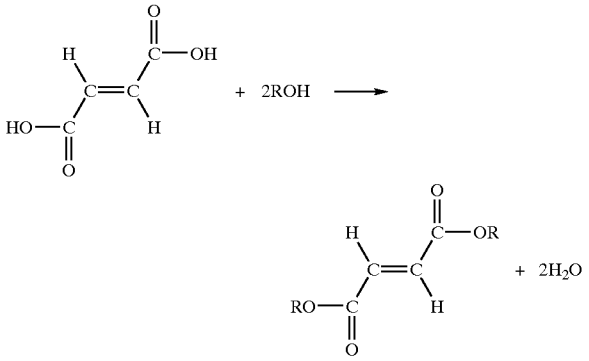

In view of the specific amount of water generated in such a reaction, the concentration of water introduced into the subsequent copolymerization step can be readily established and controlled by the concentration of the unsaturated carboxylic acid or its corresponding anhydride, or the partial ester thereof, and knowledge of the extent to which the reaction goes to completion under the process conditions employed. Additionally, water introduced in such a manner would be ideally distributed in the copolymerization reaction mixture. If such a process feature is used, it is preferred that the esterification reaction be carried to substantial completion prior to the introduction of the second monomer, e.g., vinyl acetate, in order to avoid undesirable side reactions or by-products. Similarly, it is also preferred that the esterification reaction be substantially completed before introducing the free radical initiator under temperature conditions best suited for its use. Issues of control and convenience will determine how one skilled in the engineering and copolymerization arts chooses to maintain a controllable and useful level of water in order to realize the process advantages described herein.

The copolymerization is carried out in the presence of a peroxide catalyst. The peroxide catalysts which can be employed in the process of this invention must remain active for reasonable time periods in order to be effective. This is particularly true where the process is carried out at elevated temperatures, e.g., above about 124° C. (255° F.), and many of the peroxides will not remain effective at such conditions. More specifically, a measure of this quality is the "half-life" of these peroxides, namely the time required at a specified temperature to effect a loss of one-half of the peroxide's active oxygen content. Since the process of the present invention can be carried out at lower as well as elevated temperatures, a wider variety of peroxide catalysts are suitable. At higher temperatures of copolymerization, the peroxide catalysts to be used should have a half-life of at least about 5 minutes at 100° C. (212° F.), and preferably at least about 10 minutes at 100° C. (212° F.). Such peroxides include the dibenzoyl peroxides, acetyl peroxide, t-butyl hydroperoxide, t-butyl perbenzoate, etc.; dibenzoyl peroxides is a preferred catalyst, and t-butyl peroctoate is particularly preferred. Dibenzoyl peroxide sold commercially as LUCIDOL-70, for example, has a half-life of about 20 minutes at 100° C. (212° F.). Azo free radical initiators are also useful in the present process. Examples of azo initiators are 2,2'-azobis(2,4-dimethylpentanenitrile), sold commercially as Vazoe® 52; 2,2'-azobis(2-methylpropanenitrile), sold commercially as Vazo® 64; and 2,2'-azobis(2-methylbutanenitrile), sold commercially as Vazo® 67. Useful concentrations of the peroxide or azo initiator are determined, in part, by the molecular weight of the copolymer to be produced. Whereas higher concentrations of initiator can drive conversion to higher levels (provided that the heat of polymerization is effectively removed in order to control reaction temperature), directionally, the higher the concentration of the initiator, the lower the molecular weight of the copolymer. However, one of the advantages of the present process is the achievement of higher levels of molecular weight thereby allowing for the use of an increased range of initiator concentration. Consequently, the initiator is usefully employed at an overall concentration of from about 0.01 to about 2.0; preferably from about 0.04 to about 1.0; more preferably from about 0.06 to about 0.50; most preferably from about 0.08 to about 0.30; for example, from about 0.10 to about 0.20 weight percent based on the total weight of the monomers added to the reactor.

One variant of the process in accordance with the present invention is described as a bulk copolymerization process. By this it is meant that the polymerization is conducted in the monomer reactants and the monomers act as the reaction medium or "diluent" for the reaction. In contrast, in a solution polymerization process, a separate, essentially nonreactive, fluid is added to serve as the diluent or carrier for the monomers and for the resulting copolymer. The bulk copolymerization processes are thus defined as being carried out in the substantial absence of a solvent. The phrase "substantial absence of a solvent" is meant to be specifically contrasted to commercial processes which employ solvent systems such as cyclohexane, generally in amounts of about 27% of the weight of dialkyl fumarate used therein. As described in Cashman et al., (column 4, lines 51–61), other solvents can include, for example, naphtha, lubricating oil fractions, white oils, benzene, toluene, heptane and other petroleum hydrocarbons which are inert and liquid under the conditions of the process, as well as esters, ethers and chlorinated solvents such as chloroform, carbon tetrachloride, etc. Generally, when solution polymerization is used, the monomer concentration in the diluent ranges from about 30 to about 99% by weight, based on the weight of the total mixture. When polymerization is conducted in the presence of a solvent such cyclohexane, these solvents are typically used in amounts sufficient, at least in part, to evaporate during the reaction and thus effect a cooling, which can be supplemented by other means, of the reaction mass. Suitable provision needs also to be made for solvent recycle during as part of a solution process and for removal of solvent from the final copolymer product.

When peroxide catalysts are employed in the form of a powder, such as LUCIDOL-70 dibenzoyl, a small catalyst-fluidizing amount, generally about 1 to 2% by weight, based on the weight of dialkyl fumarate, of a hydrocarbon oil-based carrier can be admixed with the powdered catalyst so as to aid in the delivery of the catalyst into the reactor. Thus, even when polymerization is carried out in the substantial absence of a solvent, it is not meant to exclude the presence of such minor amounts of a hydrocarbon oil. The small amount of hydrocarbon oil which is primarily acting as a carrier for the powdered peroxide catalyst is selected to be non-volatile under reaction conditions, and typically remains dispersed in the final copolymer product. More specifically, these hydrocarbons will preferably have a boiling point which is at least 20° C. above the maximum reaction temperature encountered during the copolymerization process of this invention. Hydrocarbon oil conventionally employed as a base oil in lubricating oil formulations can be employed as a peroxide carrier. With peroxide catalysts in liquid form, such as the preferred t-butyl peroctoate, it is not necessary to combine the catalyst with any hydrocarbon or the like in order to render it easily deliverable to the reactor. Furthermore, it is possible, but somewhat more difficult, to deliver the peroxide catalyst in the form of a powder to the reactor without the assistance of a non-volatile hydrocarbon oil.

If the copolymerization process is carried out in a diluent or solvent, an oil can also be used for this purpose; such oils typically have the characteristics noted above and, preferably, oil of the type to be used as the basestock in which the copolymer is included as a component. In the prior art processes for forming the copolymers of the present invention, such oils were to be avoided as diluents or solvents for a solution process because of the potential presence of heteroatoms that could negatively affect the polymerization, such as by causing a reduction in the molecular weight of the resulting copolymer. Such heteroatoms include nitrogen, oxygen, sulfur and combinations thereof. However, by incorporating water in the process as disclosed herein, it is possible to use oleaginous diluents and gain the benefits, economic and otherwise, of their use. For the purposes of the present invention, oleaginous diluents include both mineral and synthetic oils, the latter including for example, polyalphaolefins, adipates, etc., and mixtures of mineral and synthetics, as they are commonly used in the lubricating arts. Similarly, if the solvent or diluent contains aromatic or alkyl aromatic compounds, such compounds would have the tendency to depress the molecular weight of the copolymer if carried out using prior art processes. Such a disadvantage also can be avoided or reduced if the process of the present invention is employed. Aromatic compounds include, for example, benzene, biphenyl, naphthalene, etc. Alkyl aromatics include compounds such as toluene, ethylbenzene, xylenes, mesitylene, cumene, tetralin, methylnaphthalene, durene, isodurene, propylbenzene, cymene, diphenylmethane, 1,2-diphenylethane, etc. Without wishing to be bound by theory, it is believed that molecular weight reduction occurs as a consequence of chain transfer caused by the presence of heteroatoms and aromatic compounds during copolymerization.

The free radical initiator, e.g., the azo or peroxide compound, can be added either continuously (which may be more appropriate in the solvated process) or added in several discrete additions (particularly in the bulk or unsolvated process). Discrete additions of a portion of the overall amount of initiator intended to be used are helpful in moderating the exotherms generated in the absence of solvent. For example, in a batch process the initiator can be added in two stages to control the exotherm resulting from the peroxide addition and, furthermore, in order to adjust for the presence of a diminishing amount of monomer in such a batch reaction, the second addition is conveniently carried out by adding several portions, each representing a fraction of the amount intended to be added in the second step. For example, six steps can conveniently be used, each of the first four adding about 5–15% and each of the final two at about 30%. Useful concentrations of the free radical initiator which can be employed in the present process are described hereinabove.

The reaction of the present invention is carried out by mixing the monomers, for example, vinyl acetate with fumaric acid diester in the presence of at least a portion of the peroxide catalyst in a reaction vessel. Process temperatures in the reactor of from about 5 to 180° C., e.g., 15–150° C., alternatively, from about 50–180° C. can be employed. Generally, the reaction is initially heated to initiate the reaction, generally to a temperature of between 88° and 115° C. (190° and 240° F.), most preferably to a temperature of between about 93° and 99° C. (200° and 210° F.), at which point the reaction is initiated and the exothermic nature of the reaction causes the reaction temperature to increase. In accordance with the present invention, the reaction temperature is permitted to increase to a temperature of above about 124° C. (255° F.) and below about 160° C. (320° F.), most preferably between about 135° to 146° C. (about 275° to 295° F.). Since the reaction is conducted at elevated temperature, it is necessary to maintain the reaction vessel under pressure, primarily to prevent the loss of vinyl acetate therefrom. Generally pressures of between about 100 to 400 kPa; preferably 184 and 274 kPa (about 12 and 25 psig); and most preferably about 219 and 247 kPa (about 17 and 21 psig), can be used, with or without reflux.

The molar ratio of the comonomers, e.g., vinyl acetate to fumaric acid diester (dialkyl fumarate) should be controlled to achieve the desired molecular weight of copolymer and also considering whether or not the copolymerization is carried out in the presence or absence of a diluent and the polymerization temperature range employed. Generally, the process is capable of being employed over a broad range of comonomer concentration ranges. The ratio of monomer (b), (for example, vinyl acetate), to monomer (a), (for example, an unsaturated carboxy ester such as dialkyl fumarate), can range between about 0.5:1 to about 5.0:1; for example about 0.70:1 to 10:1; preferably between about 0.80:1 to 2.5:1. If, for example, bulk copolymerization is used, the molar ratio of vinyl acetate to fumaric acid diester can be from about 0.75 to about 1.5; preferably less than about 1.0; more preferably, molar ratios of between about 0.70 and 0.90 are preferred; most preferably between about 0.75 and 0.85. It is reported that under bulk copolymerization conditions and at molar ratios of vinyl acetate to dialkyl fumarate of greater than about 1.1 the reactor may be subject to becoming gelled as a consequence of the production of high molecular weight copolymer. Also to be considered is that even if the reactor does not gel, at the higher ratios, demulsibility of the final product may not be as required. That is, the polymer molecular structure of the product will be such that it will form a long-lasting emulsion in oil or fuel in the presence of water, a result which is highly undesirable in connection with the use of these products. The product produced in accordance with the present invention, however, has a very significant demulsibility, and will thus meet the demulsibility specification according to ASTM D 1401.

In accordance with the present process the reaction is maintained at the required temperature, and preferably from 135° to 146° C. (275° to 295° F.), for a period of one to ten hours; preferably between two and eight hours; most preferably between three and seven hours reaction time will generally vary inversely with the temperature employed. Generally, it is not necessary to quench the reaction itself, particularly when the copolymerization is conducted at elevated temperatures, since the free radical initiator, e.g., the azo or peroxide catalyst decomposes, and the reaction is terminated. Any unreacted vinyl acetate can be removed from the reactor and recycled and residual vinyl acetate present in the reaction product can be stripped therefrom in a conventional manner and the copolymer product recovered.

The process of the present invention is capable of producing copolymers, e.g., fumarate vinyl acetate copolymer, over a wide range of molecular weights. In particular, lower molecular weight copolymers can be produced having number average molecular weights (Mn) of between about 5,000 and 50,000. Alternatively, the process can be used to produce high molecular weight copolymers, for example those having number average molecular weights of between about 50,000 and 100,000. Useful copolymers having Mn of between about 5,000 and 75,000; including copolymers having Mn between 5,000 and 25,000; and copolymers having Mn between 35,000 and 60,000. By "number average molecular weight" is meant such molecular weight as determined by Gel Permeation Chromatography, calibrated with a polystyrene standard.

The copolymers of the present invention can be characterized by their specific viscosity, defined below. Useful copolymers are produced having specific viscosities in the range of between about 0.15 to 3.5; additionally, copolymers having viscosities of from about 0.2 to 1.0; also copolymers having viscosities of from about 0.25 to 0.70. As reported herein, specific viscosity of the copolymer is determined in accordance with the following equation:

$$\text{Specific Viscosity}=(\text{K-vis of Solution}/\text{K-vis of Solvent})-1$$

wherein "K-vis of Solution" is the kinematic viscosity at 40° C. of a 2.0 mass/volume percent solution of the polymer (active ingredient, or a.i., basis) in commercially available toluene as the solvent, using Ubbelohde-type viscometers with a viscometer constant of about 0.004 cSt/second; "K-vis of Solvent" is the corresponding kinematic viscosity of the solvent alone at the same temperature. All specific viscosities reported herein are determined by the above method.

Incorporation of water in the copolymerization process according to the present invention leads to several advantages not appreciated in the prior art:

(1) Impurities in the feed monomers and other materials used in the copolymerization, e.g., solvent or diluent, if used, can have the effect of depressing the molecular weight of the copolymer. The use of water leads to higher molecular weight which can reduce or eliminate the need and expense of monomer, solvent and/or diluent purification;

(2) The use of water permits copolymerization to be conducted at a higher temperature (which would ordinarily reduce copolymer molecular weight). Process advantages which can be realized, include polymerization at higher temperatures resulting in reduced polymerization time and reduced viscosity of the copolymer in the process equipment, e.g., reduced pump-out viscosity.

(3) Copolymerization can be conducted directly in a mineral or synthetic lubricant basestock. Mineral oils in particular contain components which can cause a decrease in the molecular weight of the copolymer, e.g., chain transfer agents such as allylic and benzylic hydrogen and/or heteroatoms. Avoidance of a purified solvent as the diluent or solvent for the polymerization eliminates the need for such a process component as well as the need to strip and purify the solvent for recycling. In addition, it is not necessary to carry out the additional process step of dissolving the resulting copolymer in a basestock for sale or use;

(4) The use of water permits the use of lower concentrations of monomers in the polymerization reactor. In free radical polymerization, polymer molecular weight is directly proportional to monomer concentration. Use of an excess of at least one of the monomers in the present process, e.g., fumarate-vinyl acetate copolymerization, can increase the copolymer molecular weight. However, the excess monomer(s) not incorporated in the copolymer must be stripped, purified and recovered or recycled which incurs additional expense. Use of water, with its resulting effect of increasing copolymer molecular weight permits lower monomer concentrations to be used to achieve the target molecular weight; and (5) Higher concentration of the free radical initiator relative to the monomers can potentially be used, with resulting benefits in process efficiency, while still achieving the desired level of copolymer molecular weight.

EXAMPLES

In the examples which follow, copolymerization reactions were carried out in a Parr brand, 300 $cm^3$ stainless steel reactor. Reagents included dialkyl fumarate (DAF) and vinyl acetate (VA) monomers, and tert-butyl peroctoate (TBPO) peroxide catalyst. Prior to their use, water and vinyl acetate were deoxygenated at ambient pressure using nitrogen. Where a molar ratio of DAF/VA is 1/1 was used, a typical reactor charge included 150.0 g (0.31 mole) DAF; 26.5 g (0.31 mole) vinyl acetate and 0.26 g (0.0012 mole) TBPO. Initially the DAF was added to the reactor heated at 50° C. The reactor was sealed and then evacuated and flushed with nitrogen for 10 minutes. When water was used, it was injected into the reactor prior to the addition of vinyl acetate. The vinyl acetate was then injected and the monomer mixture stirred for 15 minutes before heating to the reaction temperature. The TBPO was then injected (in single or multiple portions, as indicated) and the mixture stirred and controlled at the reaction temperature for 5 to 8 hours to complete the copolymerization reaction. Experimental conditions and results are summarized in Table 1. The copolymer was recovered following polymerization by dialyzing to separate unreacted monomer. This was accomplished with a natural rubber membrane in a Soxhlet extractor, using heptane and dialyzing for 9 hours at room temperature, followed by steam stripping the polymer to remove the heptane. Alternative means well known in the art can also be used to extract or separate the unreacted monomer from the copolymer.

TABLE 1

| Example | Water (ppm) | Reaction Temp. (° C.) | VA/DAF (mole ratio) | Active Ingredient (wt. %) | Kinematic Viscosity 100° C. (cSt) | Specific Viscosity[1] | Molecular Weight[2] Mn | Mw | Mw/Mn | Comments |
|---|---|---|---|---|---|---|---|---|---|---|
| 1 | 0 | 100 | 1.0 | 96.8 | 1,740 | 0.44 | 26,700 | 76,400 | 2.9 | |
| 2 | 5,000 | 100 | 1.0 | 96.0 | 5,760; 6,170 | 0.81; 0.82 | 46,600 | 194,500 | 4.1 | |
| 3 | 0 | 100 | 1.0 | 96.0 | — | 0.53 | 33,000 | 95,400 | 2.9 | |
| 4 | 5,000 | 100 | 1.0 | 96.5 | 5,920 | 0.79 | 48,300 | 170,600 | 3.5 | |
| 5 | — | 100 | — | 97.4 | 2,921 | 0.52 | 33,600 | 97,100 | 2.9 | Post polymerization water treatment (5,000 ppm) |
| 6 | 0 | 100 | 1.0 | 90.2 | 1,610; 1650 | — | 26,000 | 79,400 | 3.1 | |
| 7 | 5,000 | 100 | 0.8 | 94.2 | 2,710 | 0.54 | 30,700 | 94,700 | 3.1 | |
| 8 | 0 | 100 | 1.0 | 89.0 | 1,389 | 0.35 | 22,300 | 52,400 | 2.4 | 15% $C_6H_{12}$ |
| 9 | 5,000 | 100 | 1.0 | 96.7 | 2,400 | 0.53 | 28,500 | 77,800 | 2.7 | 15% $C_6H_{12}$ |
| 10 | 0 | 90 | 1.0 | 80.3 (94.5)** | 530* | 0.37 | 25,500 | 60,400 | 2.4 | 15% Blandol 85 |
| 11 | 5,000 | 100 | 1.0 | 82.7 (97.3)** | 2,015* | 0.52 | 31,700 | 91,200 | 2.9 | 15% Blandol 85 |
| 12 | 0 | 90 | 1.0 | 56.2 (66.1)** | 140* | 0.31 | 16,500 | 40,900 | 2.5 | 15% Solvent Neutral 150 |
| 13 | 5,000 | 100 | 1.0 | 74.4 (87.5)** | 558* | 0.37 | 22,600 | 51,200 | 2.3 | 15% Solvent Neutral 150 |
| 14 | 0 | 105 | 0.825 | 84.8 | 570 | — | 16,700 | 40,300 | 2.4 | |
| 15 | 2,500 | 105 | 0.825 | 82.5 | 830 | — | 21,000 | 58,600 | 2.8 | |

[1]Specific viscosity in toluene at 2%
[2]Measured using gel permeation chromatography (GPC)
*Contains 15 wt. % diluent oil
Corrected for diluent oil Examples 1, 3, 6, 8, 10, 12, and 14 were conducted in the absence of added water and are comparative examples. Examples 1 and 2 demonstrate the effect of including water during the polymerization on the molecular weight of the fumarate-vinyl acetate copolymer. The addition of 5,000 ppm of water to the monomers in the reactor increases the number-average molecular weight of the copolymer from 26,700 to 46,600 and the weight-average molecular weight from 76,400 to 194,500.

Examples 3 and 4 also demonstrate the effect of water of the molecular weight of the fumarate-vinyl acetate copolymer. The addition of 5,000 ppm of water to the monomers in the reactor increases the number-average molecular weight of the copolymer from 33,000 to 48,300 and the weight-average molecular weight from 95,400 to 170,600.

Example 5 demonstrates the necessity of having water present during the polymerization process. In Example 5 the copolymer of Example 3 was charged to the reactor and 5,000 ppm of water was added. The reactor was heated at the normal polymerization temperature (i.e., 100° C.) for 5.5 hours. The number-average molecular weight and the weight-average molecular weight of the copolymer did not increase, demonstrating that the addition of water modifies the polymerization of the monomers, not the pre-formed copolymer.

Examples 6 and 7 demonstrate that water can be used as a process control means to offset the effect of decreased vinyl acetate-fumarate ratio on molecular weight. Example 6 was performed at a vinyl acetate-fumarate ratio of 1.0. Example 7 was performed at a vinyl acetate-fumarate ratio of 0.8. With other variables held constant, decreasing the ratio of vinyl acetate to fumarate decreases the molecular weight of the copolymer. However, in Example 7, the addition of 5,000 ppm of water overcomes the effect of a decreased vinyl acetate-fumarate ratio. The number-average and weight-average molecular weights of the copolymer polymerized in the presence of water, but at a reduced vinyl acetate-fumarate ratio (i.e., Example 7) were greater than those of a copolymer polymerized in the absence of water (i.e., Example 6).

Examples 8 and 9 demonstrate that water can be used as a process control means to offset the molecular weight effect of conducting the polymerization in a diluent. Conducting the polymerization in the presence of a diluent decreases the molecular weight of the resulting copolymer. This is demonstrated by comparing the molecular weight of the copolymer from Example 8 ($M_n$=22,300, $M_w$=52,400), which was carried out in 15% cyclohexane, with Examples 1, 3, and 6 ($M_n$=26,000–33,000, $M_w$=76,400–95,400), which were polymerized in the substantial absence of a diluent. Example 9 utilized both 15% cyclohexane and the addition of 5,000 ppm water with a resulting increase in number-average molecular weight to 28,500 and weight-average molecular weight to 77,800; levels similar to those obtained in the absence of a diluent (Examples 1, 3 and 6).

Examples 10 and 11 demonstrate that water can also be used to offset the effect of a higher polymerization temperature, even when the polymerization is conducted in a diluent such as a refined mineral oil (i.e., Blandol® 85). Polymerization at an elevated temperature tends to decrease the molecular weight of the resulting copolymer. The copolymer of Example 10 was prepared at 90° C. in 15% Blandol® 85. The number-average molecular weight of the copolymer was 25,500 and its weight-average molecular weight was 60,400. The copolymerization of Example 11 was conducted at 100° C. Even though the copolymer of Example 11 was prepared at an elevated temperature, the addition of 5,000 ppm of water increased its number-average molecular weight to 31,700 and its weight-average molecular weight to 91,200, both of which are higher than those obtained at the lower temperature (i.e., Example 10).

Examples 12 and 13 demonstrate that water can be used as a process control variable to offset the effect of a higher polymerization temperature even when the process is carried out in the presence of a diluent such as mineral oil. As noted earlier, polymerization at an elevated temperature tends to decrease the molecular weight of the copolymer. The polymerization of Example 12 was conducted at a temperature of 90° C. in 15% Solvent Neutral 150. The number-average molecular weight of the resulting copolymer was 16,500 and its weight-average molecular weight was 40,900. The copolymer of Example 13 was prepared in Solvent Neutral 150, but at a higher temperature, 100° C., and in the presence of water. Even though the copolymer of Example 13 was prepared at an elevated temperature (and also in the presence of the same diluent), the addition of 5,000 ppm of water resulted in a copolymer with an increased number-average molecular weight, 22,600, and weight-average molecular weight, 51,200, compared to the copolymer of Example 12.

Examples 14 and 15 demonstrate that the effect of water is still operative under conditions of both an elevated temperature and a reduced vinyl acetate:fumarate ratio. Example 14 was prepared at 105° C. and a vinyl acetate-:fumarate ratio of 0.825. The resulting copolymer had a number-average molecular weight of 16,700 and weight-average molecular weight of 40,300. In Example 15, the addition of 2,500 ppm water increased the number-average molecular weight of the copolymer to 21,000 and its weight-average molecular weight to 58,600.

The data clearly demonstrate the advantage of including water at controlled levels during the copolymerization.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A process comprising the copolymerization of:

(a) unsaturated carboxy ester monomer selected from at least one compound represented by formulas (I) or (II), said compound formed via the esterification of an unsaturated carboxylic acid or its corresponding anhydride with one or more monohydric aliphatic alcohols having an average carbon number of between about 6 and about 24, said unsaturated carboxy ester having the formula:

(I)

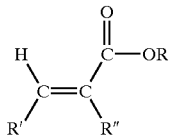

(II)

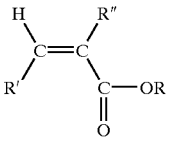

wherein R' is selected from the group consisting of hydrogen and COOR and wherein R is a $C_1$ to $C_{24}$ alkyl group and wherein R" is hydrogen or methyl; and (b) a monomer selected from the group consisting of:

(i) a vinyl ester having the formula:

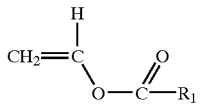

wherein $R_1$ comprises an alkyl group containing from 1 to 18 carbon atoms; and;

(ii) an olefin having the formula

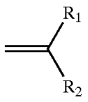

wherein $R_1$ and $R_2$ can independently be hydrogen, an alkyl having from 1 to 28 carbon atoms, or a substituted aryl group, provided both $R_1$ and $R_2$ are not hydrogen;

in a reactor, comprising reacting said unsaturated carboxy ester with said vinyl ester or olefin monomer in the presence of a free radical initiator, wherein water is present during copolymerization in an amount of from about 200 to about 10,000 parts per million by weight of the copolymerization monomers and free radical initiator.

2. The process of claim 1 wherein said water is present in an amount of from about 500 to about 5,000 parts per million.

3. The process of claim 2 wherein said water is present at less than about 3,000 parts per million.

4. The process of claim 1 wherein said water is introduced by means selected from the group consisting of: a separate feedstream; inclusion with one or more of said monomers; wherein optionally solvent or diluent is employed in said process, said solvent or diluent including a predetermined level of water; with said free radical initiator; and generated in situ.

5. The process of claim 1 wherein the molar ratio of monomer (b) to monomer (a) is from about 0.5 to about 5.0.

6. The process of claim 5 wherein said molar ratio is from about 0.75 to about 1.5.

7. The process of claim 1 carried out in the substantial absence of a solvent or diluent.

8. The process of claim 1 carried out in solution or wherein said monomers are suspended or partially dissolved in a diluent.

9. The process of claim 1 wherein at least a portion of said water is added as an independent feedstream.

10. The process of claim 1 wherein said water is added by means of a solvent or diluent including a predetermined level of water.

11. The process of claim 9 wherein said water is added at a predetermined rate during the course of said copolymerization reaction.

12. The process of claim 1 wherein said copolymer has a specific viscosity of from about 0.15 to about 3.5 as measured in toluene.

13. The process of claim 1 wherein the temperature during copolymerizaton is from about 5 to about 180° C.

14. The process of claim 13 wherein said temperature is from about 124° C. to about 160° C.

15. The process of claim 1 where said free radical initiator is employed at an overall concentration based on the total weight of said monomers added to the reactor of from about 0.01 to about 2.0 weight percent.

16. The process of claim 15 in which said overall amount of said free radical initiator is added to said reactor in more than one fractional portion.

17. The process of claim 16 wherein said free radical initiator is added to said reactor in fewer than eight portions.

18. The process of claim 1 wherein said free radical initiator is added to said reactor in a substantially continuous manner at a predetermined rate.

19. The process of claim 1 wherein said free radical initiator is selected from the group consisting of tert-butyl peroctoate, dibenzoyl peroxide and azo initiators.

20. The process of claim 1 wherein said reaction is carried out at elevated pressure.

21. The process of claim 20 wherein said pressure is from about 100 to about 400 kPa.

22. The process of claim 21 wherein said pressure is from about 184 to 274 kPa.

23. The process of claim 19 wherein said free radical initiator comprises t-butyl peroctoate, and wherein said copolymerization is conducted in the absence or substantial absence of a solvent.

24. The process of claim 23 wherein the temperature during copolymerization is from about 15 to about 180° C., and about 2,500 parts per million of water are added as a separate feedstream to said reactor prior to the start of said copolymerization and wherein (a) is dialkyl fumarate and (b) is vinyl acetate.

25. The process of claim 8 wherein said solvent or diluent is selected from the group consisting of hydrocarbon liquids and oleaginous lubricating fluids which are at least partially liquid at the temperatures and pressures at which said copolymerization process is conducted.

26. The process of claim 1 or claim 8 wherein said copolymerization is conducted in the presence of at least one chain transfer agent.

27. The process of claim 4 wherein said water is generated in situ from the substantially complete esterification of an unsaturated carboxylic acid or anhydride or partial ester thereof.

* * * * *

UNITED STATES PATENT AND TRADEMARK OFFICE

CERTIFICATE OF CORRECTION

PATENT NO. : 6,583,247 B1
DATED : June 24, 2003
INVENTOR(S) : A. Alvarino et al.

It is certified that error appears in the above-identified patent and that said Letters Patent is hereby corrected as shown below:

Column 14,
Line 55, change "$C_1$" to -- $C_6$ --.

Signed and Sealed this

Twenty-third Day of September, 2003

JAMES E. ROGAN
*Director of the United States Patent and Trademark Office*